US006087780A

United States Patent [19]

Benny

[11] Patent Number: 6,087,780

[45] Date of Patent: Jul. 11, 2000

[54] CONTROL PANEL FOR CHRISTMAS LIGHTS

[76] Inventor: Ricky Benny, 4295 Mercer Rd., Decator, Ga. 30035

[21] Appl. No.: 09/233,944

[22] Filed: Jan. 20, 1999

[51] Int. Cl.[7] ..... H05B 37/00; H01R 11/00

[52] U.S. Cl. ..... 315/185 S; 315/241 S; 361/641; 439/502

[58] Field of Search ..... 315/200 A, 241 R, 315/241 S, 292, 293, 294, 295, 129, 185 S, 362, 360, 291, 225; 307/141; 361/641, 644; 439/502

[56] References Cited

U.S. PATENT DOCUMENTS

| | | | |
|---|---|---|---|
| 3,862,434 | 1/1975 | Davis, Jr. | 315/185 S |
| 4,153,860 | 5/1979 | Vonick | 315/155 |
| 4,215,277 | 7/1980 | Weiner | 307/41 |
| 5,345,147 | 9/1994 | Wu | 315/185 |
| 5,629,587 | 5/1997 | Gray | 315/292 |
| 5,805,070 | 9/1998 | Eriksson | 340/662 |
| 5,879,184 | 3/1999 | Lopez | 439/502 |
| 5,957,564 | 9/1999 | Bruce et al. | 315/169.3 |

*Primary Examiner*—Don Wong
*Assistant Examiner*—Wilson Lee
*Attorney, Agent, or Firm*—Goldstein & Canino

[57] ABSTRACT

A control panel for Christmas lights including a housing having a pole extending downwardly therefrom. A lower end of the pole is sharpened for being inserted within a ground surface. A control panel is disposed within the open front face of the housing. The control panel has a power cord extending outwardly of the housing for coupling with an electrical outlet. A pair of light panels are disposed within the opposed open side faces of the housing. The light panels are in operative communication with the control panel. Each of the light panels have a plurality of electrical outlets therein for receiving plugs from Christmas lights therein.

3 Claims, 2 Drawing Sheets

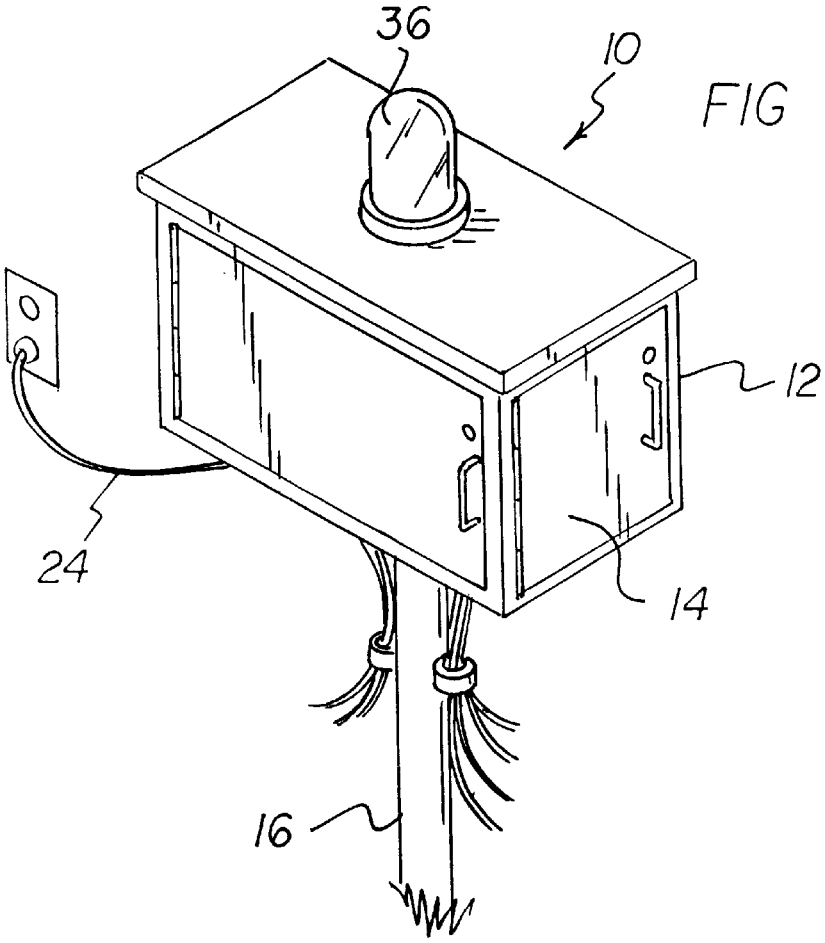
FIG 1
FIG 2
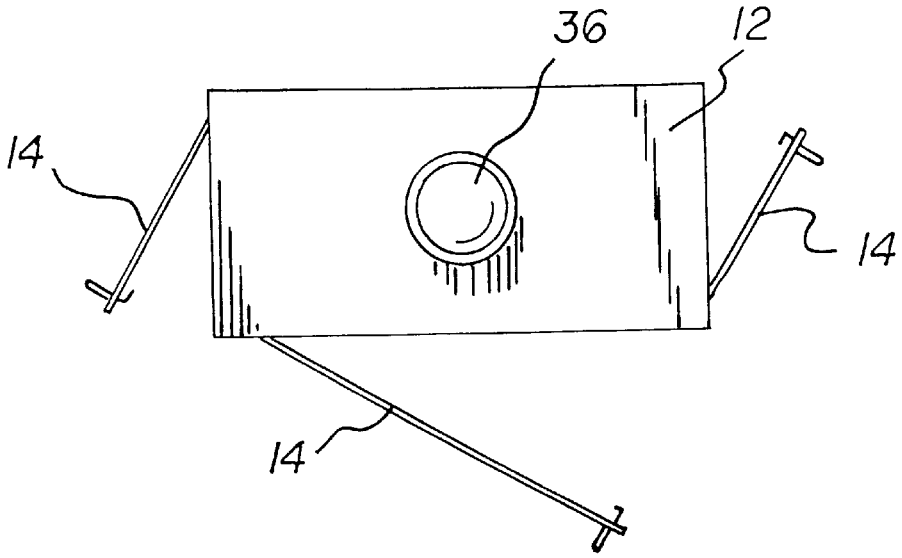

CONTROL PANEL FOR CHRISTMAS LIGHTS

BACKGROUND OF THE INVENTION

The present invention relates to a control panel for Christmas lights and more particularly pertains to allowing lights to be turned on and off at selected times and shutting off the lights in the event of a shortage or overload.

Christmas light controllers and its circuit commonly have a power plug on one end and controlled light sets on the other end, or the power plug and the controlled light sets are arranged on the same side of the controller. The control circuit of Christmas light controller consists of a rectifier, a current-limiter, a voltage regulator, an oscillator, a selector switch, a driver, and an integrated circuit; in which the integrated circuit controls its own internal codes in accordance with the action of the selector switch to govern a driver producing the light variation of an outside light set.

The present invention seeks to provide a control panel and light panels that will automatically turn Christmas light on and off at predetermined times while preventing a shortage or an overload.

The use of control devices for lighting arrangements is known in the prior art. More specifically, control devices for lighting arrangements heretofore devised and utilized for the purpose of energizing a plurality of lights are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,345,147 to Wu discloses a Christmas light controller, with a current limiter and a voltage regulator incorporated therein, having the capability of cycling the power down. U.S. Pat. No. 5,629,587 to Gray discloses a programmable lighting control system for Christmas lighting applications. U.S. Pat. No. 4,215,277 to Weiner discloses a controller for sequentially energizing Christmas light strings. U.S. Pat. No. 4,153,860 to Yonick discloses an additional Christmas light control apparatus and is provided for general interest in the art.

While these devices fulfill their respective, particular objective and requirements, the aforementioned patents do not describe a control panel for Christmas lights for allowing lights to be turned on and off at selected times and shutting off the lights in the event of a shortage or overload.

In this respect, the control panel for Christmas lights according to the present invention substantially departs from the conventional concepts and designs of the prior art, and in doing so provides an apparatus primarily developed for the purpose of allowing lights to be turned on and off at selected times and shutting off the lights in the event of a shortage or overload.

Therefore, it can be appreciated that there exists a continuing need for new and improved control panel for Christmas lights which can be used for allowing lights to be turned on and off at selected times and shutting off the lights in the event of a shortage or overload. In this regard, the present invention substantially fulfills this need.

SUMMARY OF THE INVENTION

In the view of the foregoing disadvantages inherent in the known types of control devices for lighting arrangements now present in the prior art, the present invention provides an improved control panel for Christmas lights. As such, the general purpose of the present invention, which will be described subsequently in greater detail, is to provide a new and improved control panel for Christmas lights and method which has all the advantages of the prior art and none of the disadvantages.

To attain this, the present invention essentially comprises a housing having a generally rectangular configuration. The housing has an open front face, a closed rear face, a top wall, a bottom wall, and opposed open side faces. The open front face and the opposed open side faces each have a door hingedly coupled therewith. The bottom wall has a pole extending downwardly therefrom. A lower end of the pole is sharpened for being inserted within a ground surface. A control panel is disposed within the open front face of the housing. The control panel includes a clock and a programmable timer. The control panel has a power cord extending outwardly of the housing for coupling with an electrical outlet. The control panel includes a manual shut off switch. The control panel has an operation panel. A pair of light panels are disposed within the opposed open side faces of the housing. The light panels are in operative communication with the control panel. Each of the light panels have a plurality of electrical outlets therein for receiving plugs from Christmas lights therein. The light panels each have dimmer controls therein to adjust a brightness of the Christmas lights. An alarm is secured to the top wall of the housing. The alarm is in communication with a resistor switch of the control panel whereby an electrical shortage or overload will activate the alarm.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved control panel for Christmas lights which has all the advantages of the prior art control devices for lighting arrangements and none of the disadvantages.

It is another object of the present invention to provide a new and improved control panel for Christmas lights which may be easily and efficiently manufactured and marketed.

It is a further object of the present invention to provide a new and improved control panel for Christmas lights which is of durable and reliable construction.

An even further object of the present invention is to provide a new and improved control panel for Christmas lights which is susceptible of a low cost of manufacture with regard to both materials and labor, and which accordingly is then susceptible of low prices of sale to the consuming public, thereby making such a control panel for Christmas lights economically available to the buying public.

Even still another object of the present invention is to provide a new and improved control panel for Christmas lights for allowing lights to be turned on and off at selected times and shutting off the lights in the event of a shortage or overload.

Lastly, it is an object of the present invention to provide a new and improved control panel for Christmas lights including a housing having a pole extending downwardly therefrom. A lower end of the pole is sharpened for being inserted within a ground surface. A control panel is disposed within the open front face of the housing. The control panel has a power cord extending outwardly of the housing for coupling with an electrical outlet. A pair of light panels are disposed within the opposed open side faces of the housing. The light panels are in operative communication with the control panel. Each of the light panels have a plurality of electrical outlets therein for receiving plugs from Christmas lights therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the control panel for Christmas lights constructed in accordance with the principles of the present invention.

FIG. 2 is a top plan view of the present invention.

The same reference numerals refer to the same parts through the various figures.

DESCRIPTION OF THE PREFERRED EMBODIMENT

Figure 3:
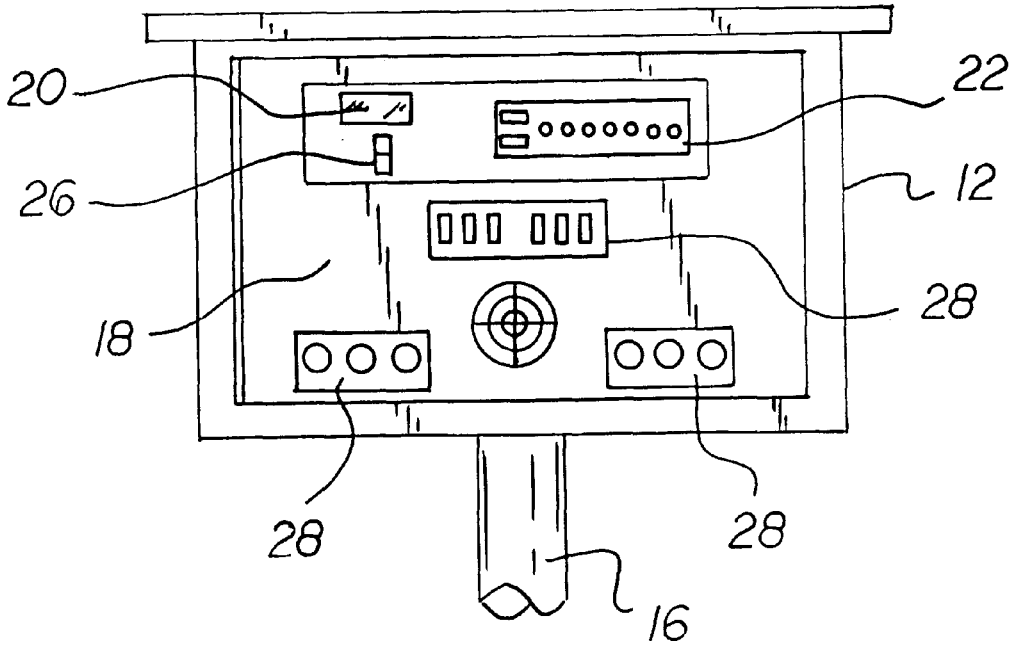
FIG. 3 is a front view of the present invention illustrating the control panel thereof.
Figure 4:
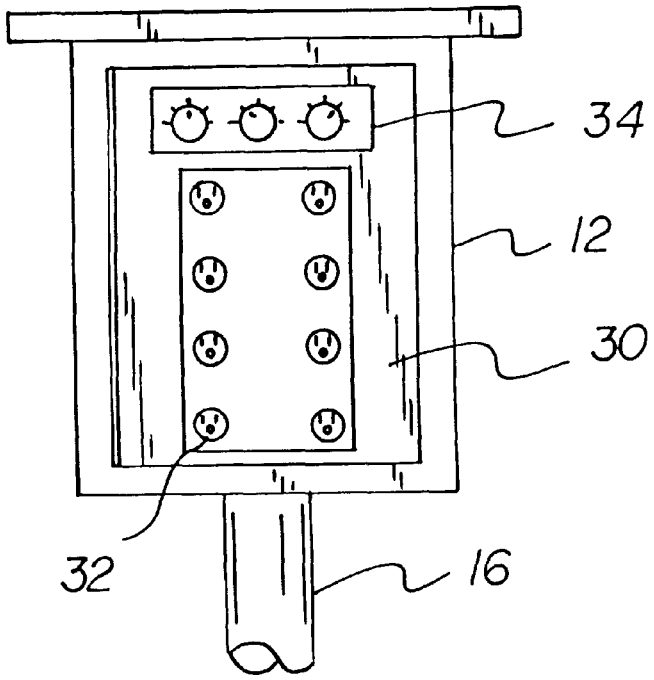
FIG. 4 is a side view of the present invention illustrating the light panel thereof.

With reference now to the drawings, and in particular, to FIGS. 1 through 4 thereof, the preferred embodiment of the new and improved control panel for Christmas lights embodying the principles and concepts of the present invention and generally designated by the reference number 10 will be described.

Specifically, it will be noted in the various Figures that the device relates to a control panel for Christmas lights for allowing lights to be turned on and off at selected times and shutting off the lights in the event of a shortage or overload. In its broadest context, the device consists of a housing, a control panel, a pair of light panels, and an alarm. Such components are individually configured and correlated with respect to each other so as to attain the desired objective.

The housing 12 has a generally rectangular configuration. The housing 12 has an open front face, a closed rear face, a top wall, a bottom wall, and opposed open side faces. The open front face and the opposed open side faces each have a door 14 hingedly coupled therewith. The doors 14 each have a handle 14 to facilitate the opening and closing thereof. Additionally, each of the doors 14 is provided with a lock to limit access. The bottom wall has a pole 16 extending downwardly therefrom. A lower end of the pole 16 is sharpened for being inserted within a ground surface. The housing 12 is preferably constructed so that it's interior is protected from the elements since it's preferable location is outdoors.

A control panel 18 is disposed within the open front face of the housing 12. The control panel 18 includes a clock 20 and a programmable timer 22. The control panel 18 has a power cord 24 extending outwardly of the housing 12 for coupling with an electrical outlet. The control panel 18 includes a manual shut off switch 26. The control panel 18 has an operation panel 28.

The pair of light panels 30 are disposed within the opposed open side faces of the housing 12. The light panels 30 are in operative communication with the control panel 18. Each of the light panels 30 have a plurality of electrical outlets 32 therein for receiving plugs from Christmas lights therein. The light panels 30 each have dimmer controls 34 therein to adjust a brightness of the Christmas lights.

The alarm 36 is secured to the top wall of the housing 12. The alarm 36 is in communication with a resistor switch of the control panel 18 whereby an electrical shortage or overload will activate the alarm 36. The alarm 36 is controlled by the operation panel 28.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A control panel for Christmas lights for allowing lights to be turned on and off at selected times and shutting off the lights in the event of a shortage or overload comprising, in combination:

a housing having a generally rectangular configuration, the housing having an open front face, a closed rear face, a top wall, a bottom wall, and opposed open side faces, the open front face and the opposed open side faces each having a door hingedly coupled therewith, the bottom wall having a pole extending downwardly therefrom, a lower end of the pole being sharpened for being inserted within a ground surface;

a control panel disposed within the open front face of the housing, the control panel including a clock and a programmable timer, the control panel having a power cord extending outwardly of the housing for coupling with an electrical outlet, the control panel including a manual shut off switch, the control panel having an operation panel;

a pair of light panels disposed within the opposed open side faces of the housing, the light panels being in operative communication with the control panel, each of the light panels having a plurality of electrical outlets therein for receiving plugs from Christmas lights therein, the light panels each having dimmer controls therein to adjust a brightness of the Christmas lights;

an alarm secured to the top wall of the housing, the alarm being in communication with a resistor switch of the control panel whereby an electrical shortage or overload will activate the alarm.

2. A control panel for Christmas lights for allowing lights to be turned on and off at selected times and shutting off the lights in the event of a shortage or overload comprising, in combination:

a housing having a pole extending downwardly therefrom, a ground surface;

a control panel disposed within an open front face of the housing, the control panel having a power cord extending outwardly of the housing for coupling with an electrical outlet;

a pair of light panels disposed within opposed open side faces of the housing, the light panels being in operative communication with the control panel, each of the light panels having a plurality of electrical outlets therein for receiving plugs from Christmas lights therein, and each of the light panels further having dimmer controls therein to adjust a brightness of the Christmas lights.

3. A control panel for Christmas lights for allowing lights to be turned on and off at selected times and shutting off the lights in the event of a shortage or overload comprising, in combination:

a housing having a pole extending downwardly therefrom, a lower end of the pole being sharpened for being inserted within a ground surface;

a control panel disposed within an open front face of the housing, the control panel having a power cord extending outwardly of the housing for coupling with an electrical outlet;

a pair of light panels disposed within opposed open side faces of the housing, the light panels being in operative communication with the control panel, each of the light panels having a plurality of electrical outlets therein for receiving plugs from Christmas lights therein;

an alarm secured to a top wall of the housing, the alarm being in communication with a resistor switch of the control panel whereby an electrical shortage or overload will activate the alarm.

* * * * *